United States Patent [19]

Sellmaier et al.

[11] Patent Number: 4,654,972

[45] Date of Patent: Apr. 7, 1987

[54] POWER SAW BLADE

[76] Inventors: Horst Sellmaier, Walsertalstr. 4, Munich 71, Fed. Rep. of Germany, D-8000; Hartwig Sandholzer, Sigmund-Freud-Str. 103, Frankfurt/M. 60, Fed. Rep. of Germany, D-6000

[21] Appl. No.: 762,730

[22] PCT Filed: Nov. 23, 1984

[86] PCT No.: PCT/DE84/00253

§ 371 Date: Jul. 23, 1985

§ 102(e) Date: Jul. 23, 1985

[87] PCT Pub. No.: WO85/02363

PCT Pub. Date: Jun. 6, 1985

[30] Foreign Application Priority Data

Nov. 23, 1983 [DE] Fed. Rep. of Germany ..... 3342323
Jul. 6, 1984 [DE] Fed. Rep. of Germany ... 8420326[U]
Sep. 14, 1984 [DE] Fed. Rep. of Germany ..... 3433746

[51] Int. Cl.[4] ..... B27B 17/02; B27B 17/14
[52] U.S. Cl. ..... 30/385; 30/387
[58] Field of Search ..... 30/381, 385, 387, 382, 30/384, 122, 166 R, 383; 125/21

[56] References Cited

U.S. PATENT DOCUMENTS

| | | | |
|---|---|---|---|
| 710,838 | 10/1902 | Brines | 30/381 |
| 1,273,394 | 7/1918 | Meyer | 30/381 |
| 1,598,853 | 9/1926 | Daw | 125/21 X |
| 1,802,129 | 4/1931 | Vaccari . | |
| 2,316,997 | 4/1943 | Smith | 30/385 |
| 2,532,981 | 12/1950 | Wolfe | 30/385 |
| 3,905,104 | 9/1975 | Albright | 30/384 |
| 4,461,269 | 7/1984 | Elliot | 30/384 |

FOREIGN PATENT DOCUMENTS

| | | | |
|---|---|---|---|
| 165565 | 1/1934 | Switzerland | 30/385 |

*Primary Examiner*—Jimmy C. Peters
*Attorney, Agent, or Firm*—Holman & Stern

[57] ABSTRACT

An elongate chain support blade of a chain saw is shaped so as to provide clearance between respective runs of the chain and longitudinal edges of the blade, thereby reducing friction and reducing oil usage. Other aspects of the invention reside in a chain guide wheel on the blade providing the chain with a short inclined chain run at the forward end, and different forms of chain-tensioning devices.

10 Claims, 6 Drawing Figures

α
III
III

POWER SAW BLADE

CROSS REFERENCE TO RELATED APPLICATION(S)

This United States application stems from PCT International Application No. PCT/DE84/00253 filed Nov. 23, 1984.

BACKGROUND OF THE INVENTION

This invention relates to a chain support blade for a chain saw wherein the blade protrudes from a motor casing of the saw, wherein a spur wheel is provided at the forward end of the blade for reversal of the chain, and a chain wheel is provided at the rearward end of the blade for transmitting drive from the motor to the chain.

Chain saws with support blades of the above type are well known, see for example U.S. Pat. No. 2,845,967, and are constructed in such a manner that the outer edges of the blade serve to support the saw chain and thus to absorb the effects of reactional diagonal forces on the longitudinal extent of the blade. In order to counteract the high friction created while sawing, oil must be applied continuously to the chain and blade. Thus, a wood cutter typically needs approximately three liters of chain saw oil per day for his saw, and this is not only costly but also contributes to pollution of the environment.

SUMMARY OF THE INVENTION

It is an object of the invention to provide an improved arrangement of chain support blade in a chain saw which substantially eliminates the need for continuous application of oil.

A chain support blade in accordance with the invention is essentially characterized by the fact that in the area between the chain-carrying wheels, the chain runs extend over substantially the entire length of the blade in spaced relation to the longitudinal edges of the blade. With this arrangement, the creation of heat due to friction of the chain against the edges of the blade no longer occurs, thus making a continuous oil application unnecessary. The use of a chain saw in accordance with the invention is thus beneficial to the environment and lowers operating costs, since substantially no oil is required. A chain saw having a blade in accordance with the invention is also easier to handle since the space needed for an oil container is no longer required, and since the cumbersome manipulation of an oil supply valve is no longer necessary.

A guide wheel may be associated with the spur wheel at the distal end of the blade, the guide wheel being located to one side and rearwardly of the forward end of the blade, the guide wheel being a particular advantage in handling the chain saw because it facilitates guiding the saw blade in particular where branches have to be cut off, but also where a cut has to be made in heavier material, since the diagonal direction of travel of the short chain run between the guide wheel and the spur wheel creates components of force directed onto the material being cut.

It should be noted that a tree cutting machine is known (see U.S. Pat. No. 846,868) which comprises an arm that pivots about a vertical axis, twice bent, and whose ends comprise pins running parallel to the main plane of the arm, to form a support for a drive pinion and a reversing pinion. The bent ends of the arm and their laterally extending pin sections prevent the use of this tree cutting machine in the manner of a hand-held power saw provided with a flat support blade, since it is impossible to guide the bent outer end of the arm into and through a tree to be cut.

Similar considerations apply to a chain saw as disclosed in U.S. Pat. No. 1,273,394 which comprises a chain having toothed outer elements activated via a pressure mechanism comprising flanged discs. This chain saw does not have a blade type support and guide for the chain and therefore also cannot be used in conventional manner to cut or cut-up trees.

In order to saw through a tree, one chain saw proposal (see U.S. Pat. Nos. 789,512 and 1,617,565) is to leave a space between a return chain run and the effective working run of the chain, and to provide at least three rolls, spaced from each other to at least such a distance that the returning free-wheeling chain run exclusively passes into and through the trunk of the tree.

A conventional chain support blade of a conventional chain saw may be readily replaced by a support blade in accordance with the present invention, so that existing saws can be used without requiring the application of chain saw oil.

With regard to steady guidance of the chain, even when heated after ong use, it has been found to be advantageous if at least one tension wheel is provided for the chain which is resiliently carried by the support blade.

Further details of the invention may be derived from the ensuing description and claims read in conjunction with the accompanying drawings.

DESCRIPTION OF PREFERRED EMBODIMENTS

Figure 1:
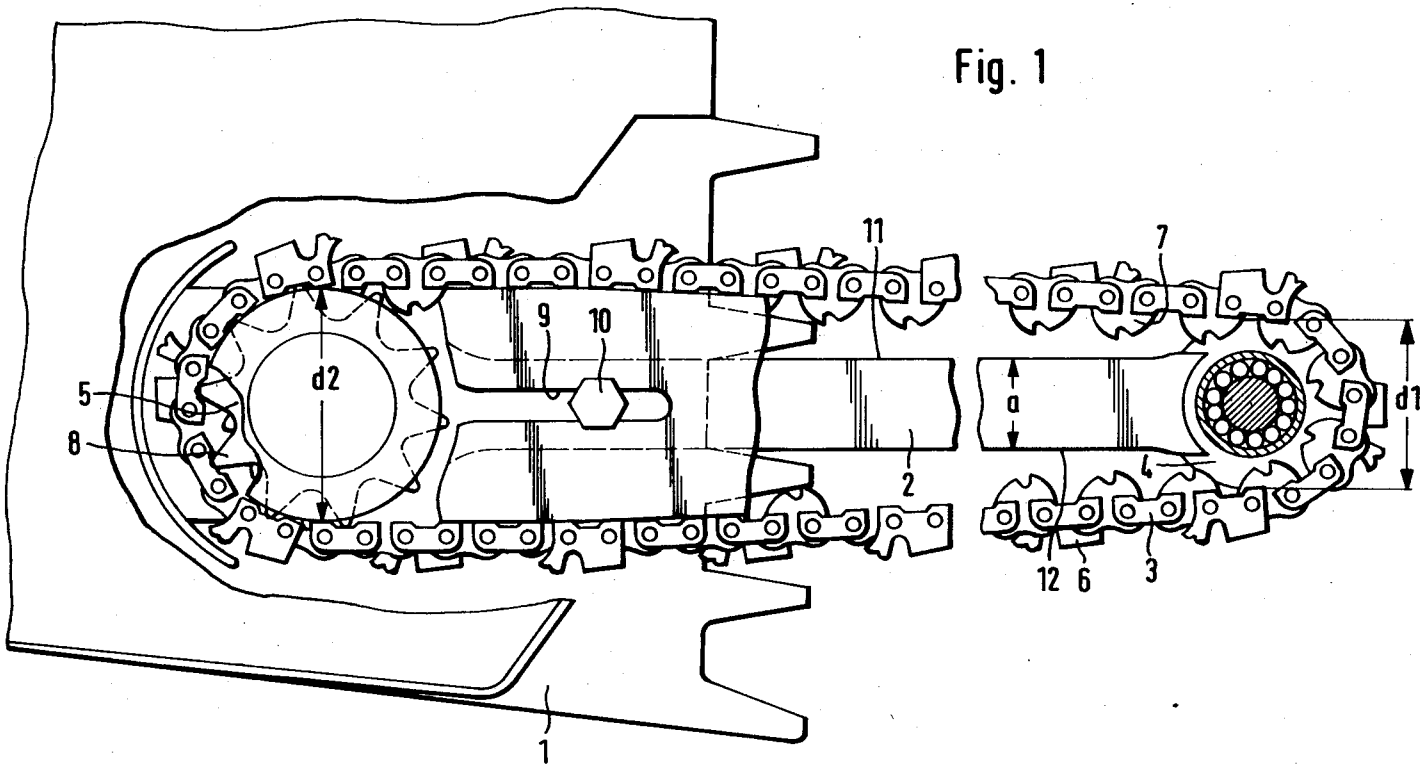
FIG. 1 is a somewhat schematical side elevational view of a chain saw having a chain support blade in accordance with the invention.

As seen in FIG. 1, a chain saw comprises a motor housing 1, shown in part only, from which projects a chain support blade 2 for a saw chain 3. At the distal end of the blade 3 there is provided a spur wheel 4 which serves to reverse the chain, and adjacent the inboard end of the blade there is a chain wheel 5 which transmits drive from the motor (not shown) of the saw to the chain 3. On its inner side facing away from the teeth 6 of the saw, the chain 3 comprises tooth-like cams 7 whose contours correspond substantially to the flanges of the teeth 8 of the chain wheel 5 between which they are gripped. In order to adjust the tension of the saw chain 3, the blade 2 comprises at its inboard end a slot 9 through which extends a set screw 10 threaded into housing 1.

The drawings show a conventional form of power saw blade 2 as presently in use insofar as the inboard end in the region of set screw 10 is concerned and as indicated by full line. The form of power saw blade in accordance with the invention is illustrated in the drawings in dotted line in the area of screw 10 and further away from this area in full line.

While in conventional chain saws, the chain support blades serves to support the saw chain in the area between spur wheel 4 and chain wheel 5, support blade 2 in accordance with the invention is in said area constructed in such a manner that both chain runs extend substantially over the entire length of the blade 2 with clearance from the edges of the blade. The drawing shows that the two outer edges 11 and 12 respectively of the blade are in the area between the spur wheel 4 and the chain wheel 5 spaced from each other at a distance (a) which is less than the smallest diameter d1 or d2 respectively of the spur wheel 4 and the chain wheel 5.

In practice, it has been found that the spur wheel 4 and the chain wheel 5 totally fulfil the purpose of supporting and guiding the chain. While running, the chain 3 assumes in loose condition and outwardly arched position, whereby it is under tension and resting against the spur wheel and the chain wheel 5 respectively. While the arching of one of the chain runs may be reduced due to the force imposed on it by material being sawed, it increases on the side of the other chain run. Due to self tension, there exists a flexible adaption to the working conditions and any danger of release or detachment of the free wheeling saw chain 3 from one of the wheels 3 and 4 respectively is effectively eliminated.

Figures 2, 3, 4, 5, 6:
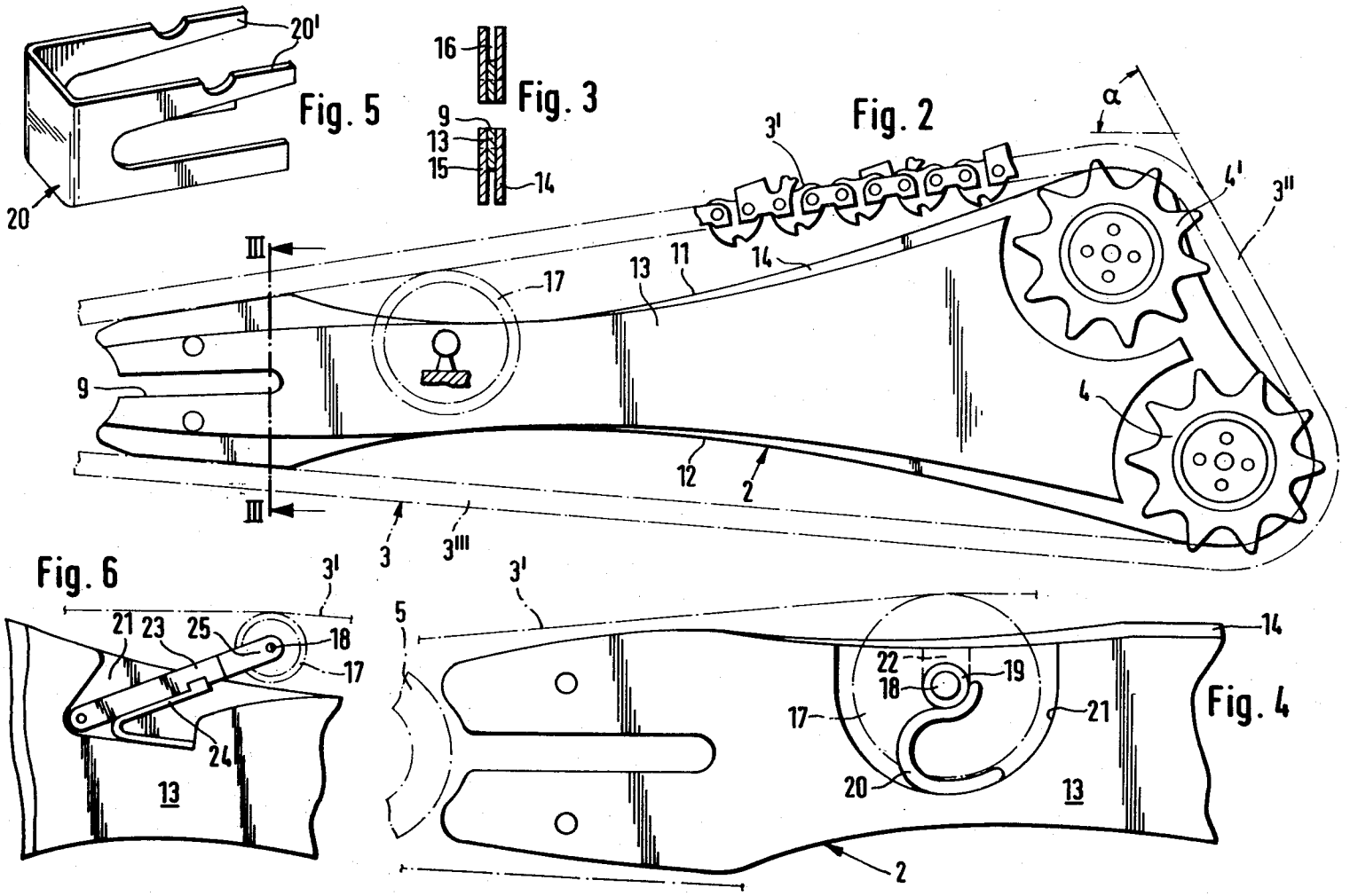
FIG. 2 is a side elevational view of a preferred form of support blade.
FIG. 3 is a sectional view on line III—III of FIG. 2.
FIG. 4 is an enlarged view of a part of a support blade showing a tension wheel in detail.
FIG. 5 is a perspective view of one form of a mount for the tension wheel.
FIG. 6 is a view similar to FIG. 4 showing an alternative form of tension wheel.

In a preferred embodiment of the blade 2 in accordance with the invention, as shown in FIGS. 2 and 3, a guide wheel 4' is positioned at the front end of the blade adjacent spur wheel 4, the guide wheel being located on one side of the spur wheel and set back therefrom.

As indicated in FIG. 3, the blade consists of three plates which are preferably riveted together to form a solid unit, the individual plates each having, for example, a thickness of about 1.5 milimeters, the plates comprising a central place 13 and two outer plates 14 and 15. In FIG. 2, the outer plate 15 facing the viewer has been removed so that the contours of the center plate 13 and the rear outer plate 14 are visible. The contours of the frontal plate 15 correspond with those of the rear plate 14. FIG. 3 shows a guide groove 16 between the outer plates 14 and 15 in which the saw chain cams engage. The chain wheel is not shown in this figure and the chain is indicated schematically only. Lateral guidance of the chain 3 in the region of the spur wheel 4 and the guide wheel 4' is provided in that here too the lateral plates 14 and 15 define a groove into which the cams of the travelling chain engage.

Chain saws comprising two staggered wheels at the front end of the support blade 2 are particularly easy to handle. The inclined running direction of the chain run 3'' from the guide wheel 4' into the spur wheel 4, at an angle of about 60 degrees in relation to the third chain run 3''', facilitates insertion of the chain into the trunk of a tree or into a tree that is to be cut up. This positioning of the chain also facilitates de-branching work of trees which have already been cut down.

FIG. 2 also shows a tension wheel 17 associated with blade 2 in the area of the motor housing 1 near the drive wheel 5, the tension wheel being in the form of a sprung pinion which, in the area where the chain run 3' runs in direction of the arrow, rests upon the chain 3 thus keeping it under tension even if it tends to lengthen when heated.

In the arrangement of the tension wheel shown in FIGS. 4 and 5, the ends 18 of a shaft for the tension wheel 17 and roller bearings 19 respectively (small needle bearings), rest upon a sprung carrier which is formed by the legs of a U-shaped saddle 20 mounted in the blade. The tension wheel 17 with its shaft ends 18 and 19 respectively and the saddle 20 are disposed in a recess 21 in the blade 2, which recess is opened toward the chain run 3', and made by punching out the center plate 13 thus forming a free space required for the tension wheel 17 and the saddle 20, which supports the ends 18 of the shaft and the roller bearing 19 respectively on legs 20'. When the blade 2 is to be dismantled and in the event that the chain run 3' is laterally shifted, the tension wheel 17 can readily be removed from recess 21 and replaced. Instead of saddle 20, spring steel wire straps could alternatively be fixed to the walls of plates 14 and 15. In another alternative, small recesses 22 may be provided in the outer plates in association with recess 21 of the center plate 13 which should be of such a size that the roller bearings 19 are able to move therein. The recesses 22 are are upwardly open as indicated in dotted line in FIG. 4 to allow for removal of the tension wheel 17.

In the embodiment shown in FIG. 6, the tension wheel 17 is mounted on a carrier formed by a pivotal guide 23 which engages with a flat spring 24. In this embodiment, more attention has been paid to the limited space available between the side plates, with forked ends 25 of the guide 23 being located outside of the recess 21 so that its width can be made to correspond to the thickness of blade 2.

While only preferred embodiments of the invention have been described herein in detail, the invention is not limited thereby and modifications can be made within the scope of the attached claims.

We claim:

1. In a chain saw having a chain assembly comprising an elongate chain support blade projecting cantileverwise from a motor casing and an endless saw chain wound around a drive wheel adjacent and inner end of the blade and a spur wheel on an outer end of the blade for penetration of the chain assembly as a whole through wood when the chain is driven by the motor, the improvement wherein the blade is shaped to provide clearance between forward and reverse runs of the chain and respective longitudinal edges of the blade along substantially the entire length of the blade.

2. The invention of claim 1 wherein the blade includes a portion between said wheels having a width which is smaller than the diameter of a smaller one of said wheels.

3. The invention of claim 1 wherein the blade includes a chain guide wheel behind and laterally spaced from the spur wheel so as to define a relatively short inclined chain run between the guide wheel and the spur wheel.

4. The invention of claim 3 wherein the positions of the wheels is such that said inclined chain run is located at an angle of about 60 degrees relative to an adjacent run of the chain.

5. The invention of claim 1 wherein the blade is formed of central and outer plates connected to together face to face, the outer plates at least in regions of said wheels extending beyond the central plate to define a peripheral chain guide groove.

6. The invention of claim 1 wherein the blade includes a spring-mounted chain tensioning wheel.

7. The invention of claim 6 wherein the tensioning wheel comprises a pinion mounted on a spring carrier located for tensioning a run of the chain moving from the drive wheel to the spur wheel.

8. The invention of claim 6 wherein the tension wheel is mounted on a bifurcated U-shaped spring carrier in a recess in the blade.

9. The invention of claim 6 wherein the tension wheel is carried on a pivotal arm in a recess of the blade and the recess includes a spring biasing the arm outwardly toward the chain.

10. The invention of claim 1 wherein the blade has an elongate slot at its inner end for attaching same to the motor and wherein the width of the blade in the region of the slot is such as to provide longitudinal edge portions of the blade engaging inner end portions of the respective forward and reverse runs of the chain.

* * * * *